US009589438B1

(12) United States Patent
Galanti

(10) Patent No.: US 9,589,438 B1
(45) Date of Patent: Mar. 7, 2017

(54) AUTOMATED OPTIMIZATION OF EAS DEVICE DETECTION

(71) Applicant: Checkpoint Systems, Inc., Thorofare, NJ (US)

(72) Inventor: Joseph R. Galanti, Blackwood, NJ (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 0 days.

(21) Appl. No.: 14/958,255

(22) Filed: Dec. 3, 2015

(51) Int. Cl.
*G08B 13/14* (2006.01)
*G08B 13/24* (2006.01)

(52) U.S. Cl.
CPC ..... *G08B 13/2431* (2013.01)

(58) Field of Classification Search
CPC combination set(s) only.
See application file for complete search history.

(56) References Cited

U.S. PATENT DOCUMENTS 5,353,011 A 10/1994 Wheeler et al.
6,862,719 B2 3/2005 Embling et al.
6,947,860 B2 * 9/2005 Frederick ..... G08B 13/2408 340/10.1
8,659,428 B2 2/2014 Soto et al.
2004/0036606 A1 * 2/2004 Frederick ..... G08B 13/2408 340/572.1
2010/0084918 A1 * 4/2010 Fells ..... H02J 5/005 307/32

* cited by examiner

*Primary Examiner* — Travis Hunnings
(74) *Attorney, Agent, or Firm* — Nelson Mullins Riley & Scarborough, LLP

(57) ABSTRACT

A tag monitoring device configured to interface with a security tag adapted to be disposed on a corresponding product in a monitoring environment may include a transmitter, a receiver and processing circuitry. The transmitter transmits a periodic signal pulse during a transmit cycle. The receiver monitors for a response from the security tag after the transmit cycle. The processing circuitry is configured to control the receiver with respect to enabling the receiver to detect the response. The processing circuitry is configured to perform dynamic tuning of the receiver by calculating an average random noise level for a predetermined period of time, comparing the average random noise level to a first threshold and a second threshold, applying an incremental gain reduction in response to the average random noise level being greater than the first threshold, and applying an incremental gain increase in response to the average random noise level being less than the second threshold.

20 Claims, 5 Drawing Sheets

AUTOMATED OPTIMIZATION OF EAS DEVICE DETECTION

TECHNICAL FIELD

Various example embodiments relate generally to retail theft deterrent and merchandise protection devices, and more particularly relate to methods and devices for improving the detection capabilities of devices that detect security tags employed for such purposes.

BACKGROUND

Security devices have continued to evolve over time to improve the functional capabilities and reduce the cost of such devices. Some security devices are currently provided to be attached to individual products or objects in order to deter or prevent theft of such products or objects. In some cases, the security devices include tags or other such components that can be detected by gate devices at the exit of a retail establishment and/or tracked while being moved in the retail establishment. These tags may sometimes also be read for inventory management purposes, and may include or otherwise be associated with specific information about the type of product to which they are attached.

In order to improve the ability of retailers to deter theft and/or manage inventory, the security devices and systems in which they operate are continuously being improved. For example, various improvements may be introduced to attempt to improve the ability of gates placed at the exits of retail establishments to detect the tags. In this regard, the gates may occasionally produce false alarms or fail to detect tags passing through the gates. When such situations are noted, field servicing and the corresponding costs associated therewith may be incurred to try to optimize system performance. Additionally, the initial setup of the system may be an onerous task aimed at trying to optimize system performance.

Accordingly, the ability to provide good accuracy of detecting the tags with relatively little setup and maintenance may be considered to be an important aspect when determining the appropriate balance of characteristics for a given system.

BRIEF SUMMARY OF SOME EXAMPLES

Some example embodiments may improve the accuracy of tag detection, but do so in a way that can provide for automated system optimization so that there is not difficulty in initializing and maintaining the system. In this regard, some example embodiments may enable an automatic optimization detection tuning process to be conducted. In some examples, the automatic optimization of detection tuning may include an automatic gain optimization for each receiver in the system. The automatic optimization detection tuning process may be employed to improve system performance without the need for repeated service calls. Thus, the cost of field service and support may be reduced and the opportunity for a plug & play electronic article surveillance (EAS) system may be realized. Optimal tuning may also reduce detection loss.

In one example embodiment, a tag monitoring device configured to interface with a security tag adapted to be disposed on a corresponding product in a monitoring environment is provided. The device may include a transmitter, a receiver and processing circuitry. The transmitter is configured to transmit a periodic signal pulse during a transmit cycle. The receiver is configured to monitor for a response from the security tag after the transmit cycle. The processing circuitry is configured to control the receiver with respect to enabling the receiver to detect the response. The processing circuitry is configured to perform dynamic tuning of the receiver by calculating an average random noise level for a predetermined period of time, comparing the average random noise level to a first threshold and a second threshold, applying an incremental gain reduction in response to the average random noise level being greater than the first threshold, and applying an incremental gain increase in response to the average random noise level being less than the second threshold.

According to another example embodiment, a security system is provided. The security system may include at least one security tag disposed on a product in a monitoring environment, and a tag monitoring device configured to interface with the at least one security tag. The tag monitoring device may include a transmitter, a receiver and processing circuitry. The transmitter may be configured to transmit a periodic signal pulse during a transmit cycle. The receiver may be configured to monitor for a response from the security tag after the transmit cycle. The processing circuitry may be configured to control the receiver with respect to enabling the receiver to detect the response. The processing circuitry may be configured to perform dynamic tuning of the receiver by calculating an average random noise level for a predetermined period of time, comparing the average random noise level to a first threshold and a second threshold, applying an incremental gain reduction in response to the average random noise level being greater than the first threshold, and applying an incremental gain increase in response to the average random noise level being less than the second threshold.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
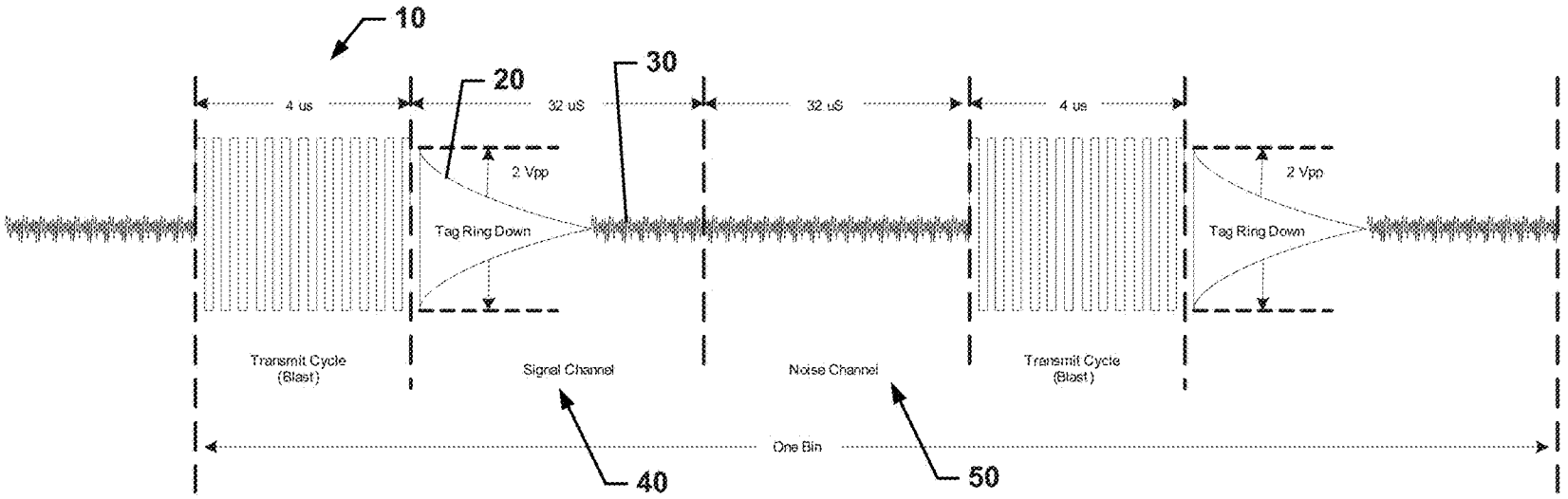
FIG. 1 illustrates a signal diagram to facilitate a description of EAS system tuning according to an example embodiment.

Some example embodiments now will be described more fully hereinafter with reference to the accompanying drawings, in which some, but not all embodiments are shown. Indeed, the examples described and pictured herein should not be construed as being limiting as to the scope, applicability or configuration of the present disclosure. Like reference numerals refer to like elements throughout. Furthermore, as used herein, the term "or" is to be interpreted as a logical operator that results in true whenever one or more of its operands are true. As used herein, "operable coupling" should be understood to relate to direct or indirect connection that, in either case, enables at least a functional interconnection of components that are operably coupled to each other.

As used in herein, the terms "component," "module," and the like are intended to include a computer-related entity, such as but not limited to hardware, firmware, or a combination of hardware and software. For example, a component or module may be, but is not limited to being, a process running on a processor, a processor, an object, an executable, a thread of execution, and/or a computer. By way of example, both an application running on a computing device and/or the computing device can be a component or module. One or more components or modules can reside within a process and/or thread of execution and a component/module may be localized on one computer and/or distributed between two or more computers. In addition, these components can execute from various computer readable media having various data structures stored thereon. The components may communicate by way of local and/or remote processes such as in accordance with a signal having one or more data packets, such as data from one component/module interacting with another component/module in a local system, distributed system, and/or across a network such as the Internet with other systems by way of the signal. Each respective component/module may perform one or more functions that will be described in greater detail herein. However, it should be appreciated that although this example is described in terms of separate modules corresponding to various functions performed, some examples may not necessarily utilize modular architectures for employment of the respective different functions. Thus, for example, code may be shared between different modules, or the processing circuitry itself may be configured to perform all of the functions described as being associated with the components/modules described herein. Furthermore, in the context of this disclosure, the term "module" should not be understood as a nonce word to identify any generic means for performing functionalities of the respective modules. Instead, the term "module" should be understood to be a modular component that is specifically configured in, or can be operably coupled to, the processing circuitry to modify the behavior and/or capability of the processing circuitry based on the hardware and/or software that is added to or otherwise operably coupled to the processing circuitry to configure the processing circuitry accordingly.

Some example embodiments may relate to improvement of a system and devices capable of detecting security devices (e.g., tags) that are attached to objects such as retail products. Detection of the tags may sometimes occur within the context of electronic article surveillance (EAS). EAS gates may be provided at a location, such as the exit of a store, to detect tags that have not been removed or deactivated from products by a store clerk when properly purchased at a point of sale. The EAS gates at store exits are familiar sights, in the form of detection pedestals. The EAS gates may use magnetic, acousto-magnetic, radio frequency (RF), microwave, combinations of the above, or other detection methods for detecting tags. Of note, an example embodiment will be described in the context of a high frequency pulse (e.g., 3 MHz to 30 MHz). However, other periodic signals or waveforms (e.g., sinusoids, square waves, etc), having corresponding other frequencies that are generated for a finite period of time followed by a generally longer off period may also be employed.

When RF tags are employed, the tags are often designed as essentially an LC tank circuit with a resonance peak in a desired frequency band. The EAS gates can sweep around the resonant frequency to detect the presence of an RF tag. The RF tags can be removed at the point of sale, or can be deactivated using a deactivator that is configured to submit the RF tag that is to be deactivated to a strong electromagnetic field that can break down, for example, a capacitor of the LC tank circuit. The deactivator may, in some cases, be a deactivation pad over which the RF tags are passed for deactivation.

In some cases, EAS devices that employ RF sensing have a pulsed high frequency (HF) amplifier to provide current to drive either deactivation pads or detection pedestals. The pulsating high current condition does not immediately dissipate after a pulse is generated. Instead, due to the various interactions created by the circuitry that is operably coupled to these components, there may be some ringing and settling that occurs after the pulse is generated. Accordingly, after RF is disabled between different interfacing antennas and pedestals, corresponding different ringing and settling times may be experienced. If the electronics (i.e., the circuitry) of such components is not allowed to settle properly before enabling receivers of such devices to attempt subsequent detections, the receivers may essentially hear themselves and cause a false alarm. In other words, if the receiver is enabled while ringing is occurring before the circuitry has settled, the receiver may detect the ringing and trigger a false alarm.

Noise levels experienced by the system can also impact the detection capabilities of the system, and the frequency of experiencing false alarms. Random noise is considered asynchronous to a typical detection system and can be caused by sweepers, lighting, door motors, or other electrical components within a retail monitoring environment. In most cases, the random noise is not a false alarm threat because the alarm level is set as a multiple of the random noise level. For example, if the average random noise level is measured, the detection threshold for triggering an alarm may be set to four times the average random noise level (or some other multiple of the average random noise level). Although random noise is not necessarily a false alarm threat, the random noise can cause loss of detection by reducing the signal to noise ratio (SNR).

In many cases, a tuning guide may be used during field tech calls in order to reduce receiver gain until the noise level is at a desired level. FIG. 1 illustrates a signal diagram to facilitate a description of EAS system tuning according to an example embodiment. As shown in FIG. 1, there may be an initial transmit cycle 10 (or blast) for a given period of time (e.g., 4 μs). After the transmit cycle 10 is disabled, the tuned resonances (e.g., capacitance and inductance) of the electronic components in the system take time to discharge or settle out. Thus, a ring down signal 20 (or tag ring down) is generated. The ring down signal 20 may eventually reach the ambient noise level 30, and become lost in the noise.

The raw data from the receiver within the system may be segmented into frames, with each frame including 32 bins (resulting from each pulsed frequency). Each frequency unique bin may include two blasts. Each blast may include a signal channel 40 and a noise channel 50. In this example, each of the signal channel 40 and the noise channel 50 are about 32 μs in duration. This provides about 64 μs of spacing between the two blasts.

The raw data from the hardware receiver is sampled and signal processing is applied to filter out noise spikes (e.g., via a median filter). The signal processing also processes many frames to remove random noise and use correlation to identify and increase the tag signal ring down (e.g., ring down signal 20). The signal processing also calculates phase and Q between the two blasts of a given bin and applies software gain to the signal to provide a method to remove standing resonances (e.g., via a high pass filter).

Each stage of this signal processing provides data for a microcontroller or processing circuitry of the system or a test device (e.g., a service tool) that may be used to display the data. In some cases, the service tool may be configured to provide a plurality of display views. In one particular situation, the views may include an A view having raw data from the receiver, a B view showing the data after application of a median filter, a C view showing the data after random noise has been removed and software gain has been applied to the signal, and a D view showing the signal with standing resonances removed using a high pass filter.

A tuning guide may often be employed by a field technician during a field tech call to reduce the receiver gain until noise in both the C and D analog views in the service tool are just peeking above the first division on the display. The C view may be the stage at which software gain is added to the raw signal and an averaging filter is used to remove spikes that could cause false alarming and loss of detection. The D view may take the C view data and apply high pass filtering to remove standing resonances and apply more software gain. However, in some cases, it is not obvious to the field technician to determine when the noise in the C and D views are just peeking. In such cases, the field technician has no indication that optimal tuning is achieved. This usually leads to the technician overtuning, which in turn causes even further loss of detection for the system.

Figure 2:
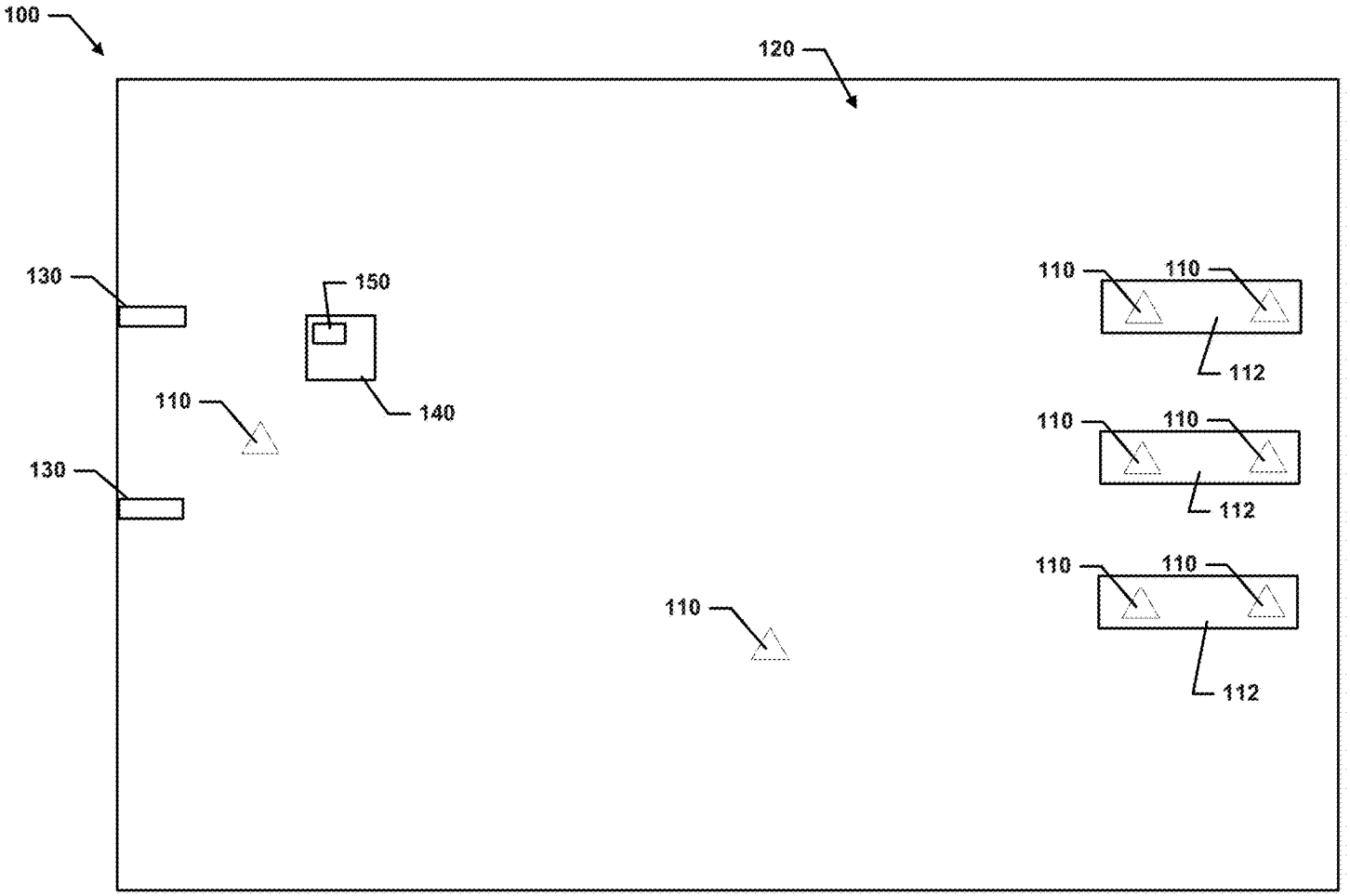
FIG. 2 illustrates a conceptual diagram of a monitoring environment within a retail store according to an example embodiment.

Some example embodiments may therefore employ an automated tuning module to test the SNR and optimally tune the system to allow for minimal loss of detection. FIG. 2 illustrates a conceptual diagram of a monitoring environment 100 within a retail store. As shown in FIG. 2, the monitoring environment 100 may include a monitoring zone 120, which may represent a relatively large area of the store (e.g., the sales floor). Tags 110 may generally be monitored while they are in the monitoring zone 120, and a detection pedestal 130 may be provided at an exit from the monitoring zone 120 to detect passage of the tags 110 through the EAS gates provided by the detection pedestal 130. As shown in FIG. 2, the tags 110 may be disposed on products that may be provided on various product displays or racks 112, which may be at various locations throughout the monitoring zone 120.

The monitoring environment 100 may also include a point of sale 140 at which retail items may be purchased. At the point of sale 140, the store clerk may take payment for the products to which the tags 110 are attached. The store clerk may also employ a deactivator 150 at the point of sale 140 in order to deactivate the tags 110 after the purchasing transaction is completed for a tagged product.

Based on the description above, it can be appreciated that both the deactivator 150 and the detection pedestal 130 may interact with the tags 110 at various times. In particular, when one of the tags 110 is brought into a field generated by the detection pedestal 130, the corresponding one of the tags 110 may be detected by the detection pedestal 130. The deactivator 150 may interact with one of the tags 110 when such tag is brought into contact with or proximate to the deactivator 150 in order to deactivate the corresponding one of the tags 110 prior to passage through the detection pedestal 130 so that the corresponding one of the tags 110 is not detected.

Figure 3:
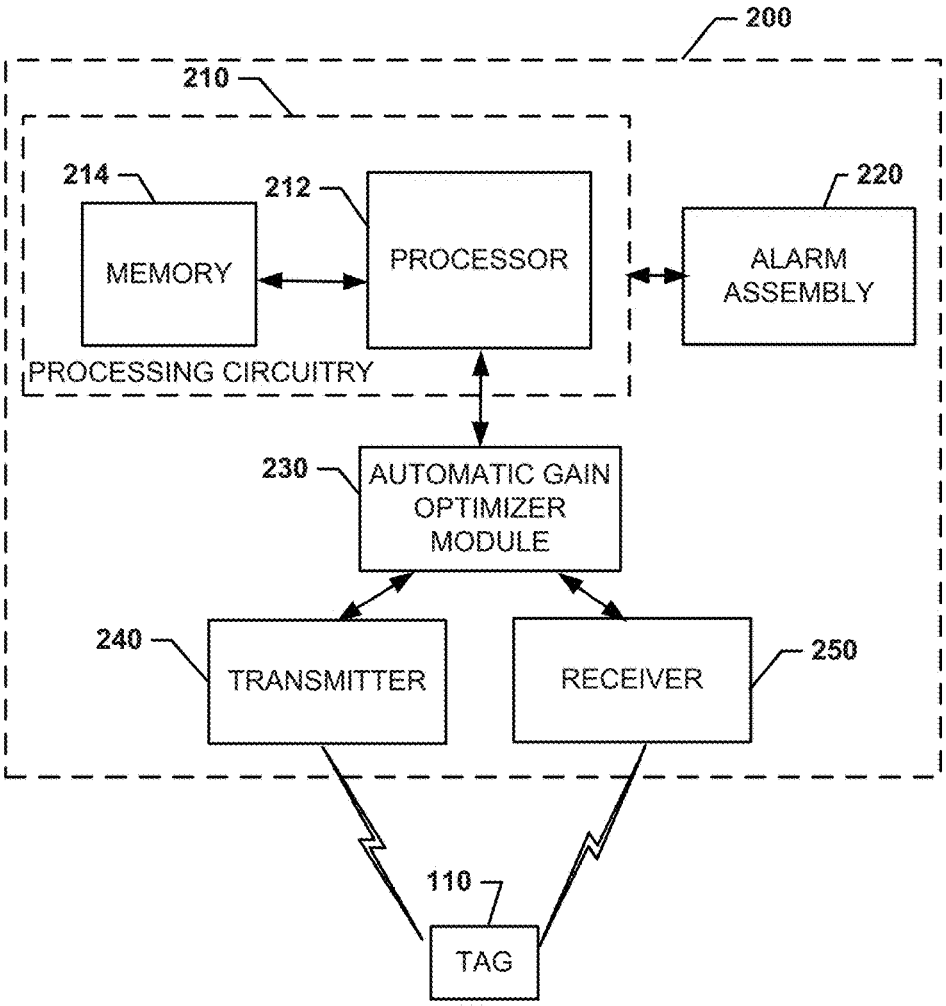
FIG. 3 illustrates a block diagram of tag monitoring equipment (or a tag monitoring device) that may be employed to monitor tags that may be placed on objects in the monitoring environment in accordance with an example embodiment.

The detection pedestal 130 may include, be embodied as or otherwise be in communication with tag monitoring equipment 200 of an example embodiment. In this regard, the tag monitoring equipment 200 may include components, modules and or processing circuitry that are configured or configurable to enable the tag monitoring equipment 200 to detect the presence of one of the tags 110 at the detection pedestal 130 so that, for example, alarm functionality may be initiated. FIG. 3 illustrates a block diagram of tag monitoring equipment 200 (or a tag monitoring device) that may be employed to monitor tags 110 that may be placed on objects (products) in the monitoring environment 100 in accordance with an example embodiment.

In some cases, the average noise level may be measured and an alarm threshold may be set as a multiple of the average noise level. Thus, for example, if the multiple is 4×, the alarm threshold may be set at four times the average noise level and any signal measured that exceeds the alarm threshold may trigger the tag monitoring equipment 200 and/or the detection pedestal 130 to sound an alarm or perform an alarm function. Given the correlation between noise level and the alarm threshold, it can be appreciated that the interaction between tag monitoring equipment 200 and the tags 110 can be impacted by SNR. Thus, it may be desirable to provide automatic gain control to adjust the gain applied for random noise measurement for any receiver that is listening for a response from the tags 110 after a pulse is generated by a transmitter of the tag monitoring equipment 200.

As shown in FIG. 3, the tag monitoring equipment 200 may include processing circuitry 210 configured in accordance with an example embodiment as described herein. In this regard, for example, the tag monitoring equipment 200 may utilize the processing circuitry 210 to provide electronic control inputs to one or more functional units (which may be implemented by or with the assistance of the of the processing circuitry 210) of the tag monitoring equipment 200 to receive, transmit and/or process data associated with the one or more functional units and perform communications necessary to enable detection of tags, issuing of alarms and/or alerts, deactivation of tags and/or the like as described herein.

In some embodiments, the processing circuitry 210 may be embodied as a chip or chip set. In other words, the processing circuitry 210 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 210 may therefore, in some cases, be configured to implement an embodiment on a single chip or as a single "system on a chip." As such, in some cases, a chip or chipset may constitute means for performing one or more operations for providing the functionalities described herein.

In an example embodiment, the processing circuitry 210 may include one or more instances of a processor 212 and memory 214. As such, the processing circuitry 210 may be embodied as a circuit chip (e.g., an integrated circuit chip) configured (e.g., with hardware, software or a combination of hardware and software) to perform operations described herein. The processing circuitry 210 may interface with and/or control the operation of various other components of the tag monitoring equipment 200 including, for example, an alarm assembly 220, a transmitter 240 and a receiver 250. The processing circuitry 210 may also include, control or be embodied as an automatic gain optimizer module 230.

In an example embodiment, the processor 212 (or the processing circuitry 210) may be embodied as, include or otherwise control the hold-off manager 230 (or components thereof). As such, in some embodiments, the processor 212 (or the processing circuitry 210) may be said to cause each of the operations described in connection with the automatic gain optimizer module 230 (or components thereof) by directing the automatic gain optimizer module 230 (or respective components) to undertake the corresponding functionalities responsive to execution of instructions or algorithms configuring the processor 212 (or processing circuitry 210) accordingly.

The processor 212 may be embodied in a number of different ways. For example, the processor 212 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 212 may be configured to execute instructions stored in the memory 214 or otherwise accessible to the processor 212. As such, whether configured by hardware or by a combination of hardware and software, the processor 212 may represent an entity (e.g., physically embodied in circuitry—in the form of processing circuitry 210) capable of performing operations according to example embodiments while configured accordingly. Thus, for example, when the processor 212 is embodied as an ASIC, FPGA or the like, the processor 222 may be specifically configured hardware for conducting the operations described herein. Alternatively, as another example, when the processor 212 is embodied as an executor of software instructions, the instructions may specifically configure the processor 212 to perform the operations described herein. In some cases, the processor 212 may be embodied as a single entity, or may be distributed amongst other entities (e.g., such that processors of or associated with multiple components including the receiver 250, transmitter 240, or another entity cooperate with each other to perform various functions).

In an example embodiment, the memory 214 may include one or more non-transitory memory devices such as, for example, volatile and/or non-volatile memory that may be either fixed or removable. The memory 214 may be configured to store information, data, applications, instructions or the like for enabling the automatic gain optimizer module 230 to carry out various functions in accordance with example embodiments.

The alarm assembly 220 (if included) may include an audio device (e.g., a piezoelectric, mechanical, or electromechanical beeper, buzzer, or other audio signaling device such as an audible alarm). The alarm assembly 220 may include a speaker or other sound generating device. In some example embodiments, the alarm assembly 220 may also or alternatively include visible indicia (e.g., lights of one or more colors such as a bi-color (e.g., red/green) LED). The visible indicia of the alarm assembly 220 and/or the audio device thereof may be used in various ways to facilitate notification of the detection of one of the tags 110 by the tag monitoring equipment 200.

The transmitter 240 may include components and circuitry for transmission of an HF pulse that may be provided at a particular frequency (e.g., the resonant frequency of the tags 110) or may be swept over a range of frequencies around the resonant frequency of the tags 110. The transmitter 240 may also include a transmission antenna (or array of antennas), a signal generator, amplification circuitry, cabling and/or the like. The transmitter 240 may generate the HF pulse under the control of the processing circuitry 210 for timing control purposes.

After the HF pulse is transmitted, the receiver 250 may be enabled to listen for return signals generated responsive to receipt of the HF pulse by one of the tags 110. The receiver 250 may therefore include a receive antenna (or array of antennas), filters, signal processing circuitry, amplifiers, cabling and/or the like. In some cases, some of the components of the receiver 250 and the transmitter 240 may be shared between them. However, in other cases, the transmitter 240 and receiver 250 may each include distinct components. In an example embodiment, the receiver 250 may include multiple individual receivers (e.g., RX1 and RX2) that are individually controllable or tunable via the automatic gain optimizer module 230.

The receiver 250 and/or the transmitter 240 may be enabled for operation on a selective basis. In other words, the receiver 250 and/or the transmitter 240 may not continuously operate, but may instead have their on and off periods controlled by the processing circuitry 210. Similarly, the gain (and/or the multiplier) of the receiver 250 may be controlled by the processing circuitry 210 (e.g., via operation of the automatic gain optimizer module 230). In an example embodiment, the automatic gain optimizer module 230 may be any means such as a device or circuitry embodied in either hardware, or a combination of hardware and software that is configured to control the tuning of the receiver 250 and/or the transmitter 240. As such, the automatic gain optimizer module 230 may be configured to receive signal data measured at the receiver 250 and make adjustments to receiver gain to optimize detection capabilities of the receiver 250 and/or the system in general.

In an example embodiment, the automatic gain optimizer module 230 may be configured to measure a calculated average random noise level to adjust the same to a level that is just slightly over the noise floor of the system. In this regard, there is a noise channel and a signal channel available for each blast. The value of each noise channel over many bins may be averaged and the result may be used for the SNR determination. The average random noise level may then be calculated using an average of all the bins for each frame. A running average over many frames for each given receiver port (e.g., RX1 and RX2) may then be employed.

If the average random noise level is above the noise floor threshold, chances are that there is an external random noise source within the active pedestal field (e.g., of the detection pedestal 130). This may lower the SNR undesirably and thereby also reduce the detection capability of the system. The automatic gain optimizer module 230 may therefore be configured to automatically operate to improve the SNR in such a situation. For example, in this situation, the automatic gain optimizer module 230 may be configured to lower the receiver gain for this port to thereby increase the SNR and improve detection capabilities. The automatic gain optimizer module 230 may therefore minimize the amount of loss of detection that can occur in such conditions.

Figure 4:
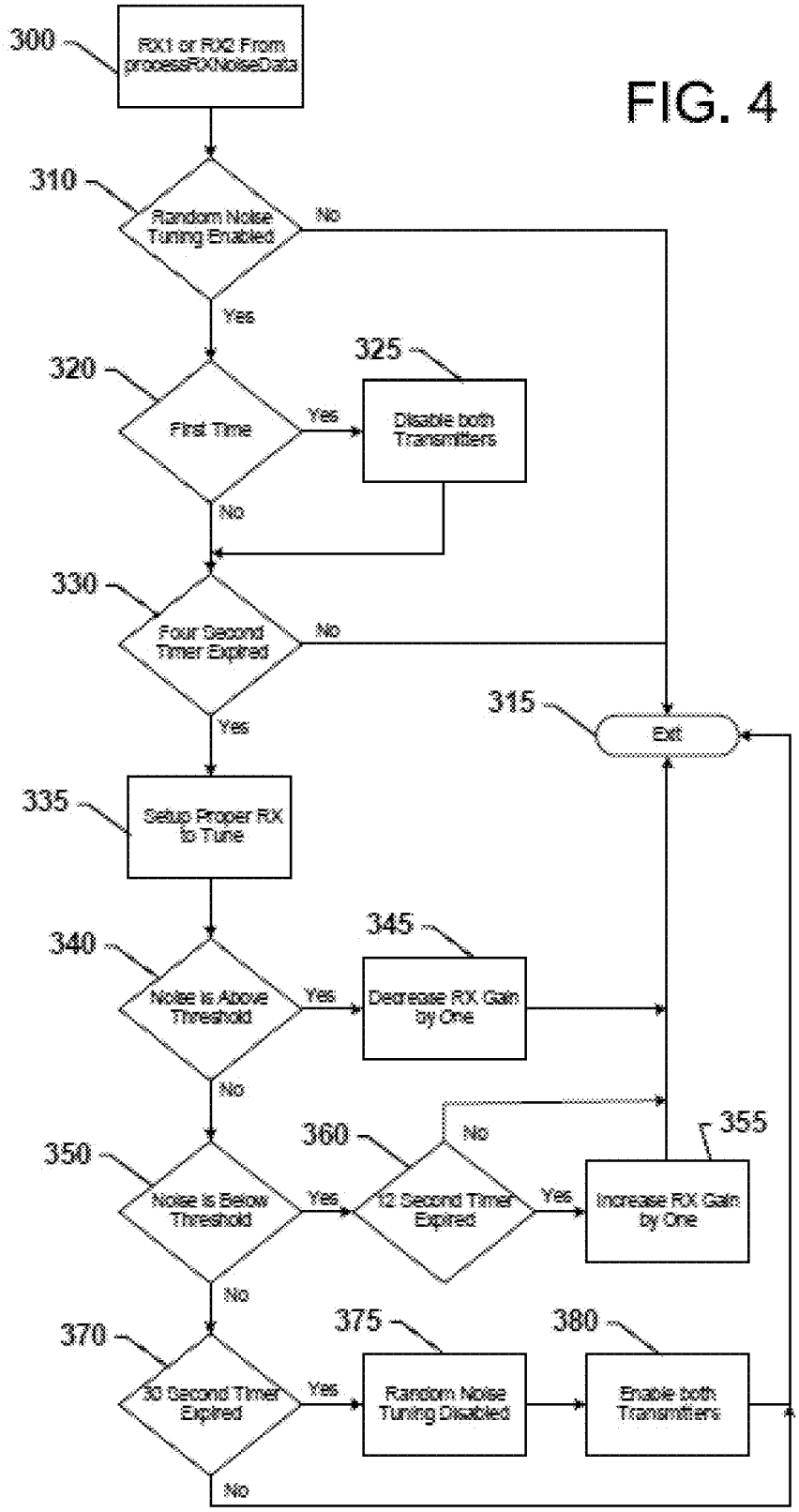
FIG. 4 illustrates a tuning algorithm that may be employed for dynamic tuning in accordance with an example embodiment.

In an example embodiment, the automatic gain optimizer module 230 may be configured to operate by executing an external random noise tuning algorithm. FIG. 4 illustrates a block diagram of an example external random noise tuning algorithm of an example embodiment. As shown in FIG. 4, random noise data may initially be processed at operation 300 from either RX1 or RX2. Calculation of average random noise levels may generally be performed for each frame iteration.

In some example embodiments, the employment of random noise tuning may be a selectable feature. Thus, for example, a determination may be made at operation 310 as to whether or not random noise tuning is enabled. If random noise tuning is not enabled, operation of the algorithm may stop or otherwise return to the beginning at operation 315. However, if random noise tuning is enabled, then the algorithm may proceed. In some cases, an enabling flag for execution of the algorithm may be set by a technician using the service tool. In other cases, the enabling flag may be set by a store manager or other personnel associated with the retail store at which the monitoring environment 100 is instantiated.

In cases where the algorithm is enabled, a determination may be made at operation 320 as to whether the algorithm is being initiated for a first time. If so, both transmitters may initially be disabled at operation 325 to ensure no interference from noise generated internally by the transmitters. Thus, the tuning may be ensured to be accomplished only for external noise sources. If the algorithm is not being run for the first time, or after disabling of the transmitters, data may be captured for a predetermined period of time at operation 330. In some cases, the length of the predetermined period of time may be sufficient to ensure that a buffer used to store the data is flushed or cleared so that average random noise level determinations only include new (and not old) data. Four seconds (e.g., about 500 frames) is likely sufficient to clear the buffer. However, other time periods (shorter or longer) may be employed in other examples.

At operation 335, the receiver that is to be tuned (e.g., RX1 or RX2) may be setup. Thereafter, the average random noise level may be tested against certain thresholds to try to adjust the average random noise level to be just above the ideal noise floor. Thus, in some cases, these thresholds (or at least one such threshold) may be set just above the ideal noise floor. If the average random noise level is above a first threshold at operation 340, the receiver gain for the corresponding port may be reduced by a predetermined amount (e.g., by a value of 1 increment) at operation 345. If the average random noise level is below a second threshold at operation 350, the receiver gain for the corresponding port may be increased by a predetermined amount (e.g., by a value of 1 increment) at operation 355. Of note, in some cases, the average random noise level may need to be below the second threshold for at least a second predetermined time (e.g., 12 seconds), as shown at operation 360, before the gain adjustment of operation 355 may be accomplished. By waiting the second predetermined time, system electronic may settle out regardless of the Q of the system.

If the average random noise level lies between the two thresholds (e.g., between the first and second thresholds) for at least a second predetermined period of time (e.g., 30 seconds) at operation 370, then the tuning may be disabled at operation 375. After noise is reduced, the algorithm may perform the same test described above and increase receiver gain for the given receiver port. Thus, the tuning adjustments can be performed independently for both RX1 and RX2. At the end of the test or algorithm performance, both transmitters may be restored to their original levels at operation 380.

In embodiments in which the service tool is used to initiate the algorithm, some indication may be provided to the service tool user while the tuning process is active regarding the new receiver gain that is set for each port. This may be accomplished via an event and a dedicated service tool page, respectively, in some cases. Example embodiments may reduce the cost of field service support and may achieve optimal tuning to reduce detection losses. Example embodiments may also be useful in moving detection systems (e.g., EAS systems) toward a plug & play capability.

Figure 5:
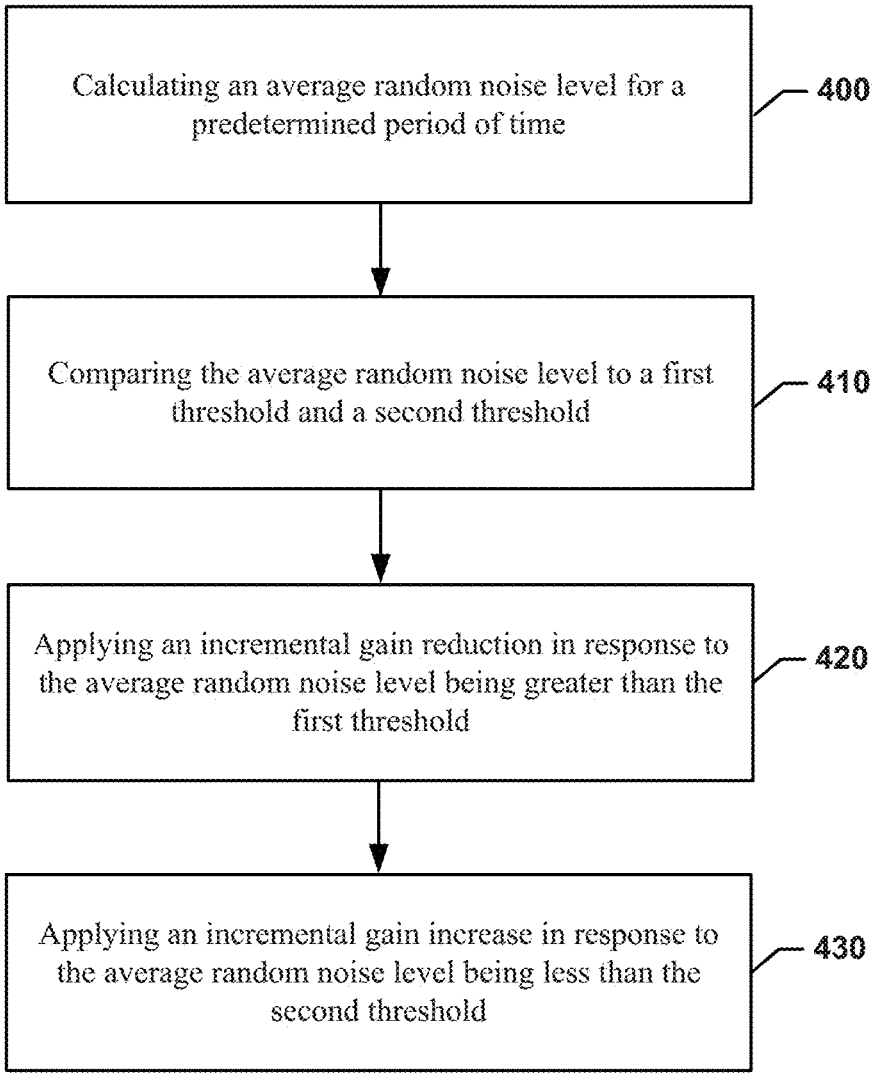
FIG. 5 illustrates a block diagram of an automatic tuning process in accordance with an example embodiment.

In an example embodiment, the processing circuitry 210 may therefore be configured to receive information indicative of the enablement of an automated tuning function and execute the corresponding automated tuning. Thus, from a technical perspective, the processing circuitry 210, as described above, may be used to support some or all of the operations described above. As such, the platform described in FIGS. 2 and 3 may be used to facilitate the implementation of several computer program and/or network communication based interactions. As an example, FIG. 5 is a flowchart of an example method and program product according to an example embodiment. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device of a computing device and executed by a processor in the computing device. As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions. Such programming or instructions may, in some cases, transform the processing circuitry 210 into an automatic system tuning device that measures system response and adjusts system parameters automatically to control the operation of system devices.

In this regard, FIG. 5 illustrates a block diagram showing a method of performing dynamic or automatic tuning for a tag monitoring device configured to monitor a security tag adapted to be disposed on a corresponding product in a monitoring environment. The monitoring environment may include a transmitter, a receiver and processing circuitry.

The transmitter may be configured to transmit a high frequency pulse or other periodic signal pulse during a transmit cycle. The receiver may be configured to monitor for a response from the security tag after the transmit cycle. The processing circuitry may be configured to control the receiver with respect to enabling the receiver to detect the response. The processing circuitry is configured to perform dynamic tuning of the receiver by calculating an average random noise level for a predetermined period of time at operation 400, comparing the average random noise level to a first threshold and a second threshold at operation 410, applying an incremental gain reduction in response to the average random noise level being greater than the first threshold at operation 420, and applying an incremental gain increase in response to the average random noise level being less than the second threshold at operation 430.

In some embodiments, the features described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, the tag monitoring device may include or be embodied as a tag detection pedestal. In an example embodiment, the first threshold may be greater than the second threshold. In an example embodiment, a magnitude of the incremental gain reduction and a magnitude of the incremental gain increase are equal. In an example embodiment, calculating the average random noise level may be performed for an individual selected receiver. In an example embodiment, the method may further include performing the dynamic tuning responsive to receiving an indication to apply the dynamic noise tuning via an enablement flag set by a service tool. In an example embodiment, the predetermined period of time may be a time sufficient to flush a buffer in which the data for calculation of the average random noise level is stored. In an example embodiment, the dynamic tuning may be performed for each frame sample period. In an example embodiment, the dynamic tuning may be performed independently for each of at least two separate receivers. In an example embodiment, applying the incremental gain increase may be performed responsive to expiry of a second predetermined period of time.

Example embodiments may provide a security system that can effectively protect a product to which a security tag is attached from theft, by providing an automatically tunable detection device that minimizes false alarms and maximizes detection capabilities. By enabling the security device to be detected more effectively and with fewer false alarms, effectiveness may be increased while overall satisfaction of a retailer using instances of the security device to protect products may be improved.

Many modifications and other examples of the embodiments set forth herein will come to mind to one skilled in the art to which these embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A tag monitoring device configured to interface with a security tag adapted to be disposed on a corresponding product in a monitoring environment, the tag monitoring device comprising:

a transmitter configured to transmit a periodic signal pulse during a transmit cycle;

a receiver configured to monitor for a response from the security tag after the transmit cycle; and processing circuitry configured to control the receiver with respect to enabling the receiver to detect the response, wherein the processing circuitry is further configured to perform dynamic tuning of the receiver by:

calculating an average random noise level for a predetermined period of time;

comparing the average random noise level to a first threshold and a second threshold;

in response to the average random noise level being greater than the first threshold, applying an incremental gain reduction; and in response to the average random noise level being less than the second threshold, applying an incremental gain increase.

2. The device of claim 1, wherein the tag monitoring device comprises a tag detection pedestal.

3. The device of claim 1, wherein the first threshold is greater than the second threshold.

4. The device of claim 1, wherein a magnitude of the incremental gain reduction and a magnitude of the incremental gain increase are equal.

5. The device of claim 1, wherein calculating the average random noise level is performed for an individual selected receiver.

6. The device of claim 1, further comprising performing the dynamic tuning responsive to receiving an indication to apply the dynamic noise tuning via an enablement flag set by a service tool.

7. The device of claim 1, wherein the predetermined period of time is sufficient to flush a buffer in which the data for calculation of the average random noise level is stored.

8. The device of claim 1, wherein the dynamic tuning is performed for each frame sample period.

9. The device of claim 1, wherein the dynamic tuning is performed independently for each of at least two separate receivers.

10. The device of claim 1, wherein applying the incremental gain increase is performed responsive to expiry of a second predetermined period of time.

11. A security system comprising:

at least one security tag disposed on a product in a monitoring environment; and a tag monitoring device configured to interface with the at least one security tag, the tag monitoring device comprising:

a transmitter configured to transmit a periodic signal pulse during a transmit cycle;

a receiver configured to monitor for a response from the security tag after the transmit cycle; and processing circuitry configured to control the receiver with respect to enabling the receiver to detect the response, wherein the processing circuitry is further configured to perform dynamic tuning of the receiver by:

calculating an average random noise level for a predetermined period of time;

comparing the average random noise level to a first threshold and a second threshold;

in response to the average random noise level being greater than the first threshold, applying an incremental gain reduction; and in response to the average random noise level being less than the second threshold, applying an incremental gain increase.

12. The system of claim 11, wherein the tag monitoring device comprises a tag detection pedestal.

13. The system of claim 11, wherein the first threshold is greater than the second threshold.

14. The system of claim 11, wherein a magnitude of the incremental gain reduction and a magnitude of the incremental gain increase are equal.

15. The system of claim 11, wherein calculating the average random noise level is performed for an individual selected receiver.

16. The system of claim 11, further comprising performing the dynamic tuning responsive to receiving an indication to apply the dynamic noise tuning via an enablement flag set by a service tool.

17. The system of claim 11, wherein the predetermined period of time is sufficient to flush a buffer in which the data for calculation of the average random noise level is stored.

18. The system of claim 11, wherein the dynamic tuning is performed for each frame sample period.

19. The system of claim 11, wherein the dynamic tuning is performed independently for each of at least two separate receivers.

20. The system of claim 11, wherein applying the incremental gain increase is performed responsive to expiry of a second predetermined period of time.

* * * * *